United States Patent [19]

Tarnoff et al.

[11] Patent Number: 4,952,190

[45] Date of Patent: Aug. 28, 1990

[54] DEFORMABLE ARTICLE

[75] Inventors: Howard R. Tarnoff, Easton, Pa.; Victor G. Reiling, West Cornwall, Conn.

[73] Assignee: Main Street Toy Company, Inc., West Simsbury, Conn.

[21] Appl. No.: 365,822

[22] Filed: Jun. 14, 1989

[51] Int. Cl.[5] ..... A63H 3/00; A63B 37/00

[52] U.S. Cl. ..... 446/267; 446/385; 273/58 H

[58] Field of Search ..... 446/267, 385, 220, 224, 446/491; 273/58 H, 58 R, 424

[56] References Cited

U.S. PATENT DOCUMENTS

| | | | |
|---|---|---|---|
| 2,795,425 | 6/1957 | Orms | 446/224 X |
| 3,347,545 | 10/1967 | Nichols | 446/267 X |
| 3,601,923 | 8/1971 | Rosenberg | 446/267 |
| 3,646,704 | 3/1972 | Ellsworth | 446/224 |
| 4,169,336 | 10/1979 | Kuhn | 446/267 |

*Primary Examiner*—Mickey Yu

*Attorney, Agent, or Firm*—Fishman, Dionne & Cantor

[57] ABSTRACT

A novelty toy including a flexible bladder in any desired shape having a sealable filling stem for receiving a moldable filling medium such as a cohesive mixture of hollow or solid microspheres and water, wherein after being filled with the filling medium the filling stem is sealed and pushed into the flexible bladder.

13 Claims, 2 Drawing Sheets

DEFORMABLE ARTICLE

BACKGROUND OF THE INVENTION

This invention generally relates to a novelty toy. More particularly, it relates to a deformable toy in any of a variety of shapes such as a ball, doll, etc.

As is known, toys such as balls, dolls and the like are generally form stable. That is, once a toy is designed in a particular shape, it essentially retains said shape throughout its useful life.

While there are deformable toys such as bean bags and clay-filled balls, bean baqs do not retain a deformed state and clay-filled balls tend to harden over time and provide a relatively dense product which can cause injury to a user and/or damage to the play environment.

SUMMARY OF THE INVENTION

In accordance with the present invention, a deformable toy is presented wherein a flexible bladder in any desired shape is provided with a sealable filling means for receiving a light-weight moldable filling medium comprising a cohesive mixture of plastic microspheres and a compatible liquid such as water. When the flexible bladder is substantially filled with the moldable filling medium and the filling stem is sealed and tucked away within the bladder, a unique ball-like product is produced which has unique tactile capabilities, i.e. is light, can be thrown or hit very hard and can be caught with bare hands with little or no discomfort.

It is the object of the present invention to provide a novelty toy in a variety of shapes which is deformable.

It is another object of the present invention to provide a novelty toy which may be thrown or hit very hard yet which can be caught with a bare hand with little or no discomfort.

It is a further object of the present invention to provide a novelty toy, such as a ball, which is substantially filled with a cohesive mixture comprised of plastic microspheres and a compatible liquid such as water.

It is a still further object of the present invention to provide a novelty toy having a portion thereof which has the appearance of a navel.

It is also an object of the present invention to provide a novelty toy which is durable yet inexpensive to manufacture.

The above and other objects, features and advantages of the present invention will be better appreciated and understood from the following detailed description and the accompanying drawings.

BRIEF DESCRIPTION OF THE DRAWINGS

Referring to the drawings, wherein like elements are numbered alike in the several FIGURES.

DESCRIPTION OF THE PREFERRED EMBODIMENTS

Referring to FIGS. 1–4 and 6, a novelty toy in the shape of a ball is shown generally at 10. As shown, the toy is comprised of two major parts, a flexible bladder 12 and a moldable filling medium 14.

Figure 6:
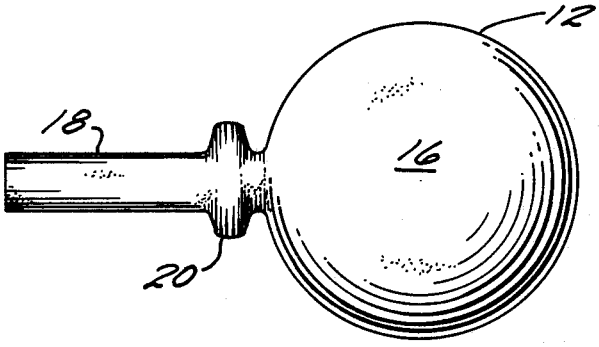
FIG. 6 is a plan view of a bladder used to make the novelty toy show in FIG. 1.

As best seen in FIG. 6, the bladder 12 comprises a sphere-shaped hollow pouch or balloon 16 and an elongated filling stem 18 extending outwardly from said balloon 16. The filling stem 18 is further provided with a relief portion 20 disposed adjacent the outer surface of the pouch or balloon 16, the use of which will be explained below.

The bladder 12 may be formed from a variety of latex forming materials such as synthetic rubber or plastic. It may be fabricated through the use of standard balloon manufacturing processes such as dipping a mandrel in a selected latex. While a typical skin thickness is preferably approximately .03 in., said thickness may vary according to the ultimate use of the novelty toy.

The filling medium 14 may be generally described as a cohesive mixture of microspheres and a compatible liquid, i.e. a liquid which is compatible with both the microspheres and the bladder material. Said liquid may include water, mineral oils, glycols, etc. Said microspheres are hollow or solid generally spherical particles having diameters of from about 0.0001 in. to about 0.06 in. and a density of from about 4.0 lbs/ft.$^3$ to about 10 lbs/ft.$^3$. While said microspheres may be produced from a variety of materials such as synthetic plastics, glass, etc., it is preferable that they be produced from synthetic plastics which form non-toxic mixtures with the chosen compatible liquid. In this regard, it has been found that Phenolic resin microspheres sold under the trademark "UCAR" Phenolic Microballoons by Union Carbide Corporation perform exceptionally well. The UCAR Phenolic Microballoons are reddish-brown hollow spheres ranging from 0.0002–0.05 in. in diameter and have a density of from about 4.5 to about 9.6 lbs./ft.$^3$. When mixed with a small amount of water or other compatible liquid, the microspheres form a cohesive moldable mixture which is used to substantially fill the balloon 16 of the bladder 12. The final density of the microsphere/water mixture is desirably close to that of the phenolic microspheres in that very little water should be used in the mixture. The final product, i.e. a substantially filled ball having a diameter of approximately $2\frac{1}{4}$ in., will have a mass significant enough to Permit the ball to be thrown with significant speed; however, due to the lightness and deformability, the ball will not damage solid objects or injure one's hand as deformation of the ball absorbs much of the force exerted upon it.

Figure 1:
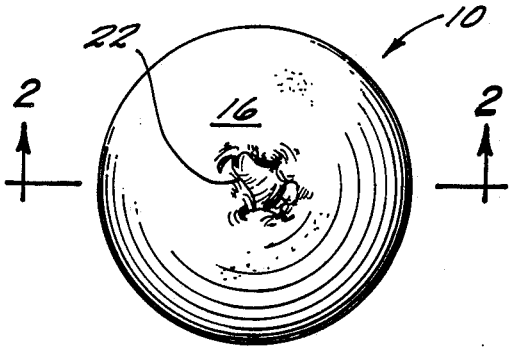
FIG. 1 is a top plan view of the novelty toy of the present invention.
Figure 2:
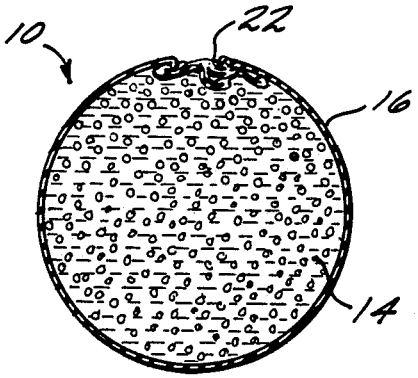
FIG. 2 is a section view taken along lines 2—2 of FIG. 1.
Figure 3:
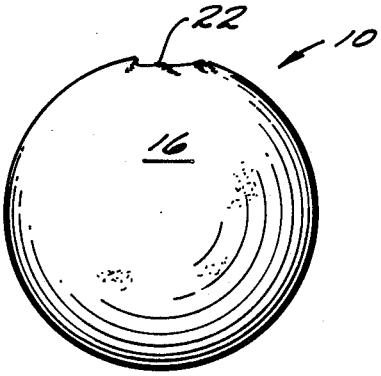
FIG. 3 is a side elevation view of the novelty toy shown in FIG. 1.
Figure 4:
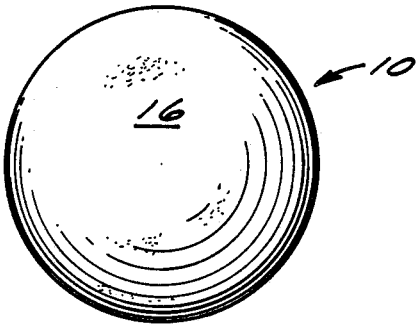
FIG. 4 is a bottom plan view of the novelty toy shown in FIG. 1.

From the above and with reference to FIG. 6, it is understood that the filling medium 14 for the bladder 12 is deposited therein through stem 18. When the stem 18 is sealed, as by gluing same, the stem 18 is rolled down upon itself to the relief portion 20. When this has been accomplished, the stem 18 is then pushed into the relief 20 and the relief 20 with stem rolled up therein is pushed into the interior of the pouch or balloon 16. This action creates the appearance of a navel 22, as shown in FIG. 1.

Figure 5:
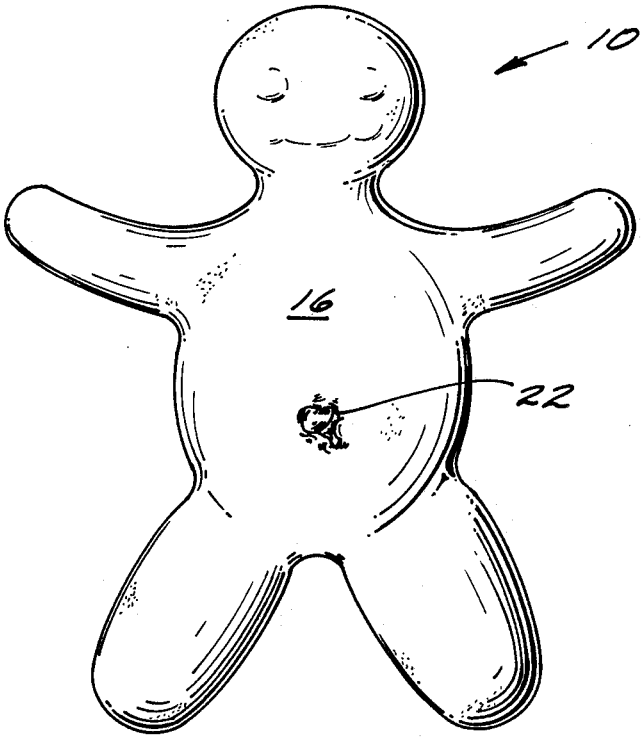
FIG. 5 is a plan view of an alternative embodiment of the novelty toy of the present invention.

An alternative embodiment of the present invention is shown in FIG. 5. As depicted, the pouch or balloon portion 16 is shown in the form of a doll-like figure. In this instance, the bladder 12 is also provided with a stem with relief portion (not shown) which subsequent to substantially filling the pouch 16 with a filling medium 14, is sealed, rolled and pushed into the interior of the doll-like pouch 16 so as to create the appearance of a navel 22.

What is claimed is:

1. A deformable article, comprising:

a flexible bladder; and a cohesive and moldable filler medium substantially filling said flexible bladder, said filler medium comprising a mixture of low density microspheres and a small amount of a compatible liquid, said small amount being effective to provide cohesion and moldability to the filler medium and said deformable article exhibiting a low density.

2. The article of claim 1, wherein the article is capable of absorbing impact energy by deformation.

3. The article of claim 1, wherein the bladder comprises a synthetic rubber or synthetic plastic.

4. The article of claim 1, wherein the microspheres comprise hollow synthetic plastic microspheres or hollow glass microspheres.

5. The article of claim 4, wherein the microspheres comprises hollow phenolic microspheres having diameters from about 0.0001 inch to about 0.06 inch and having a density from about 4.0 $lb/ft^3$ to about 10 $lb/ft^3$.

6. The article of claim 1, wherein the compatible liquid comprises water, a mineral oil, or a glycol.

7. The article of claim 1 wherein the flexible bladder includes a filling stem having a relief portion therein adjacent to the outer surface of said flexible bladder.

8. The article of claim 7, wherein the filling stem is adhesively sealed, rolled into said relief portion and pushed into the interior of said bladder to seal the bladder.

9. The article of claim 1, wherein the article comprises a substantially spherical article.

10. The article of claim 9, wherein the article has a diameter of about $2\frac{1}{4}$ inches.

11. The article of claim 1, wherein the article is a doll-like article.

12. The article of claim 1, wherein the microspheres exhibit a density of from about 4.0 $lb/ft^3$ to about 10 $lb/ft^3$.

13. The article of claim 12, wherein the filler medium exhibits a density of from about 4.0 $lb/ft^3$ to about 10 $lb/ft^3$.

* * * * *